US012226017B2

(12) United States Patent
Cardenas

(10) Patent No.: US 12,226,017 B2
(45) Date of Patent: Feb. 18, 2025

(54) PLANT STORAGE MOUNT SYSTEM

(71) Applicant: Carlos Cardenas, Victoria, TX (US)

(72) Inventor: Carlos Cardenas, Victoria, TX (US)

( * ) Notice: Subject to any disclaimer, the term of this patent is extended or adjusted under 35 U.S.C. 154(b) by 83 days.

(21) Appl. No.: 18/133,595

(22) Filed: Apr. 12, 2023

(65) Prior Publication Data

US 2024/0341473 A1 Oct. 17, 2024

(51) Int. Cl.

*A47B 96/00* (2006.01)
*A47B 96/02* (2006.01)
*A47G 7/04* (2006.01)

(52) U.S. Cl.

CPC ..... *A47B 96/028* (2013.01); *A47G 7/041* (2013.01)

(58) Field of Classification Search

CPC ..... A47B 96/028; A47B 96/06; A47B 96/061; A47G 7/041; A47G 7/044; A47H 27/00
USPC ... 108/108, 42, 152, 29, 31, 157.13, 157.14, 108/147.17, 149; 248/247, 248, 252, 208, 248/250, 254; 211/105.1, 123, 113, 211/88.03, 75, 85.23, 90.01; 47/40
See application file for complete search history.

(56) References Cited

U.S. PATENT DOCUMENTS 640,567 A * 1/1900 Johnson
720,583 A * 2/1903 Hazzard
798,683 A * 9/1905 Ketteman
883,001 A * 3/1908 Curtis
1,283,029 A * 10/1918 Arntz ..... A47L 3/02 248/248
1,989,294 A * 1/1935 Serpico ..... A47G 7/044 211/88.03
2,029,246 A 1/1936 Mccarroll
2,051,241 A * 8/1936 May ..... A47G 7/045 211/88.03
2,278,391 A 3/1942 Hunter
4,869,451 A 9/1989 Gordon
5,020,756 A * 6/1991 Bauer ..... E06B 7/28 248/250
5,704,410 A 1/1998 Kuo
5,899,147 A * 5/1999 Clayton ..... A47B 96/028 108/42
6,540,093 B1 * 4/2003 Shumway ..... A47B 57/404 108/147.11
2009/0230070 A1 9/2009 Anderson

FOREIGN PATENT DOCUMENTS

DE 3423655 12/1983
KR 200470916 Y1 * 1/2014

* cited by examiner

*Primary Examiner* — Janet M Wilkens

(57) ABSTRACT

A plant storage mount system for positioning plant pots in indirect sunlight in an upper section a windowsill includes a window frame including a top edge, a bottom edge, and a pair of lateral edges. A curtain support is coupled to the window frame and suspends curtains therefrom. A plurality of brackets is mounted to the window frame. Each of the brackets is elongated and has a top surface and a bottom surface. Each of the brackets includes a mounting section being mounted to the top edge of the window frame. A receiving section supports a bottom side of a shelf thereon, thus a top side of the shelf supports one or more plant pots thereon.

2 Claims, 5 Drawing Sheets

PLANT STORAGE MOUNT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to brackets and more particularly pertains to a new bracket for positioning plant pots in indirect sunlight in an upper section a windowsill.

(2) Description of Related Art Including Information Disclosed Under 37 CFR 1.97 and 1.98

The prior art relates to brackets and includes a variety of brackets being mountable to a windowsill or supporting a plant pot. Known prior art does not include a bracket being mounted to an upper section of a windowsill and holding a shelf configured for displaying plant pots.

BRIEF SUMMARY OF THE INVENTION

An embodiment of the disclosure meets the needs presented above by generally comprising a window frame including a top edge, a bottom edge, and a pair of lateral edges. A curtain support is coupled to the window frame and is configured for suspending curtains therefrom. A plurality of brackets is mounted to the window frame. Each of the brackets is elongated and has a top surface and a bottom surface. Each of the brackets includes a mounting section being mounted to the top edge of the window frame. A receiving section is configured for supporting a bottom side of a shelf thereon, wherein a top side of the shelf supports one or more plant pots thereon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
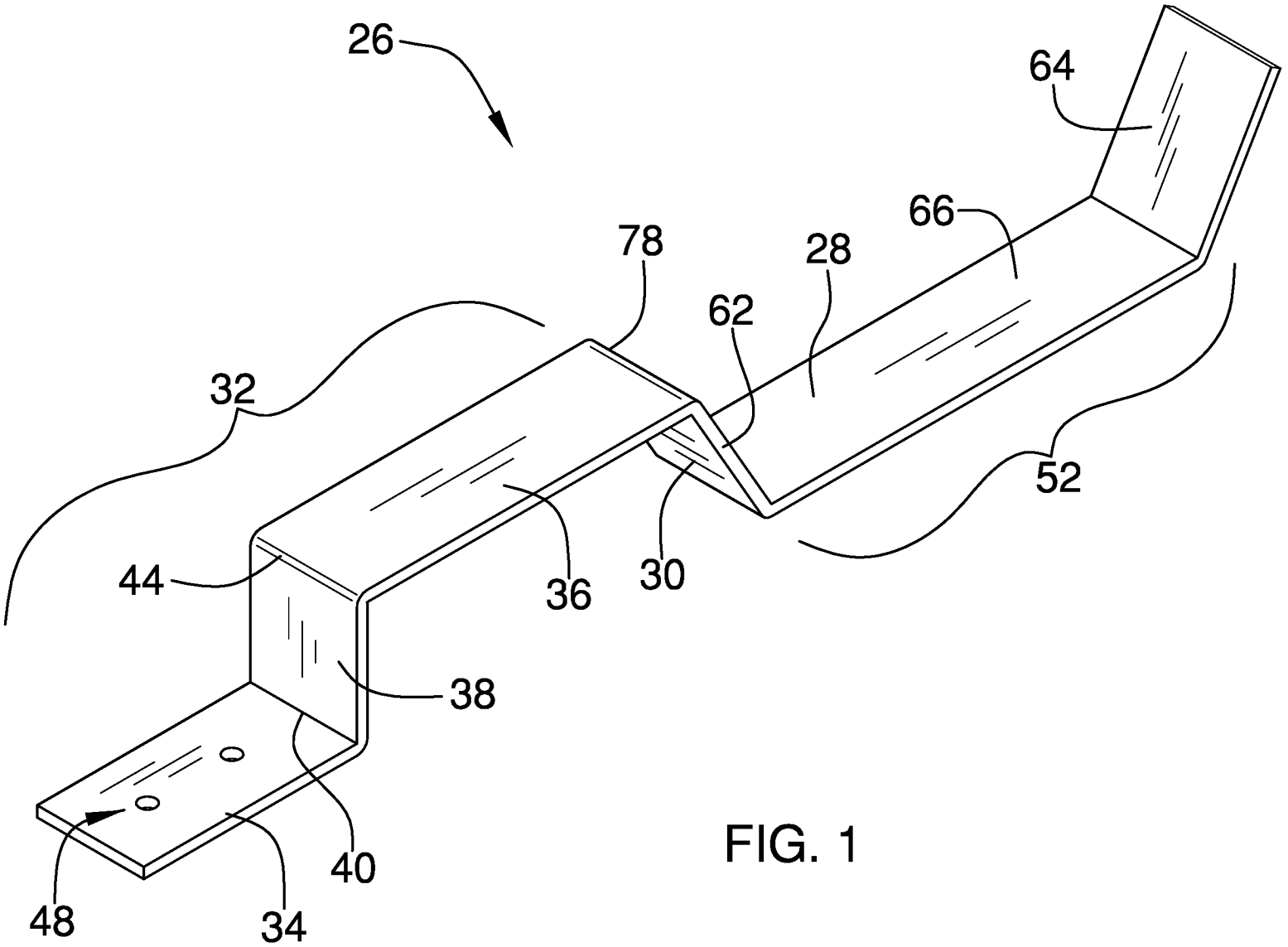
FIG. 1 is a top isometric view of a plant storage mount system according to an embodiment of the disclosure.
Figure 2:
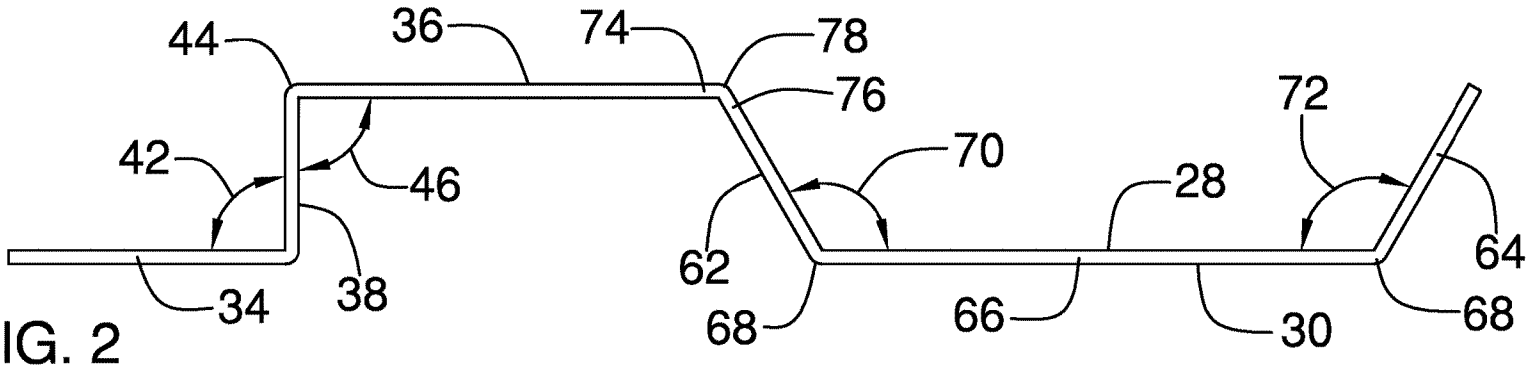
FIG. 2 is a front view of an embodiment of the disclosure.
Figure 3:
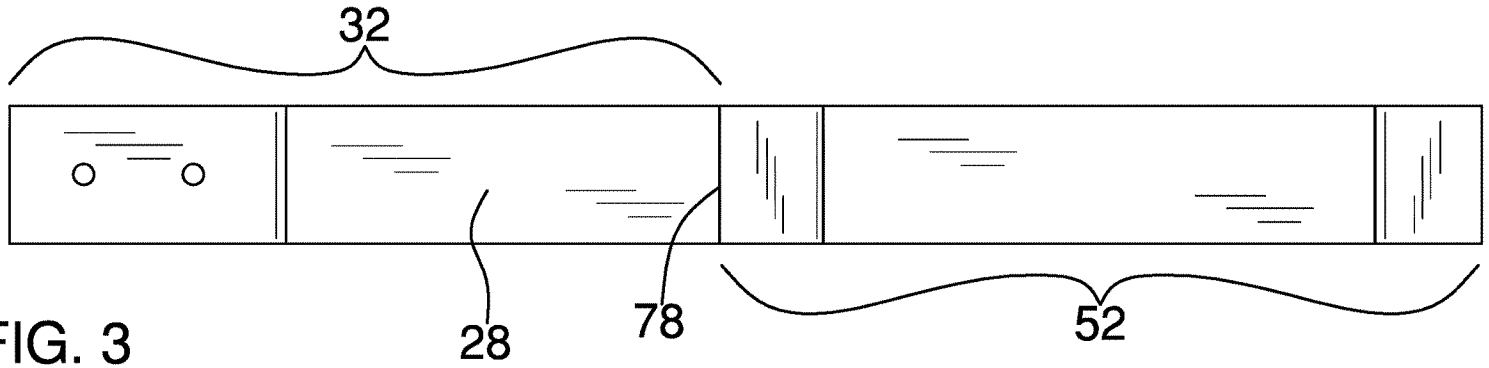
FIG. 3 is a bottom view of an embodiment of the disclosure.
Figure 4:
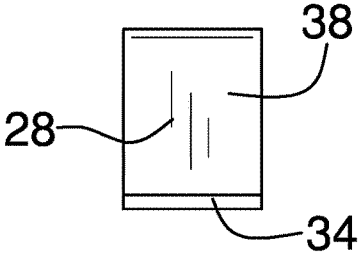
FIG. 4 is a side view of an embodiment of the disclosure.
Figure 5:
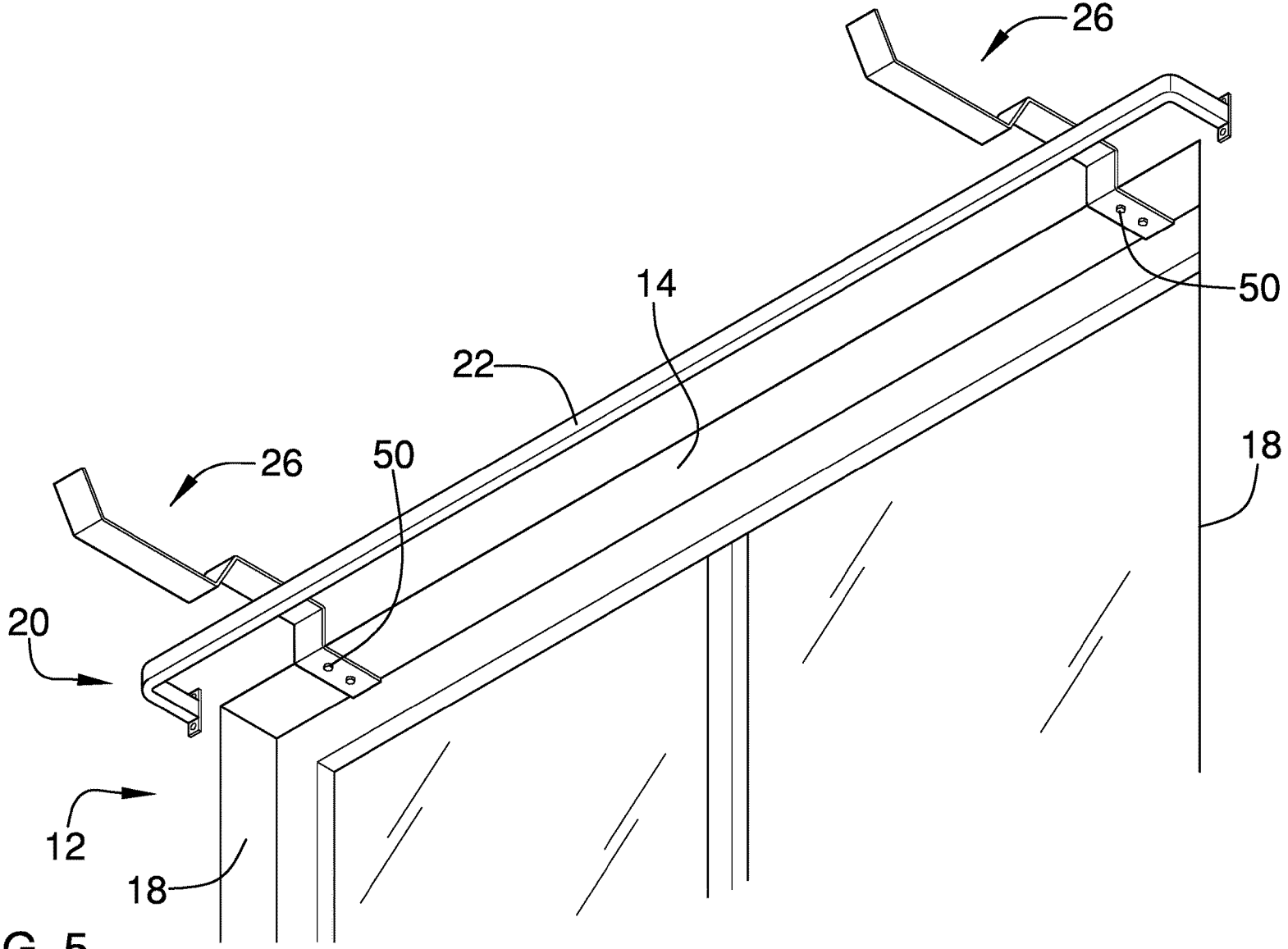
FIG. 5 is an in-use view of an embodiment of the disclosure.
Figure 6:
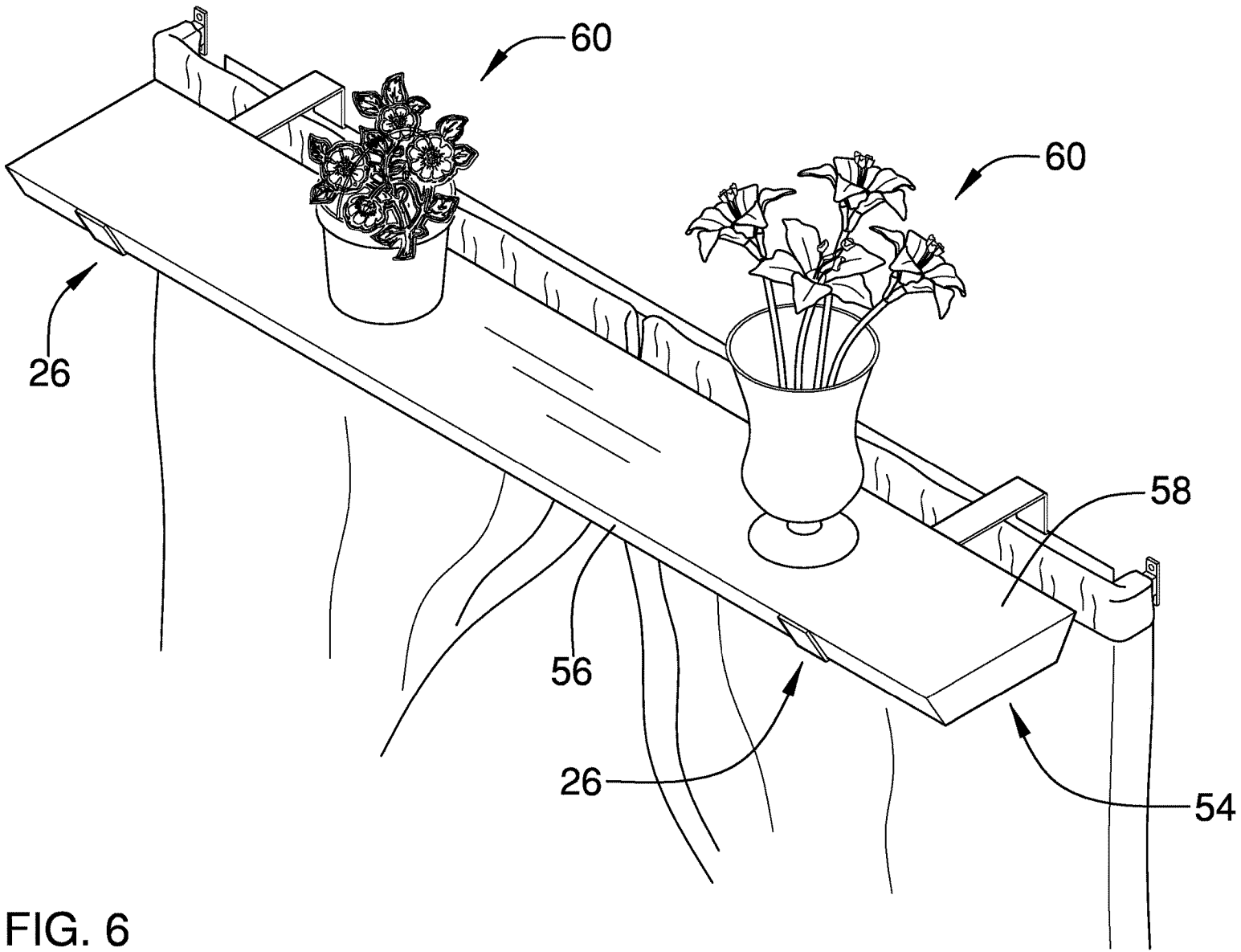
FIG. 6 is an in-use view of an embodiment of the disclosure.
Figure 7:
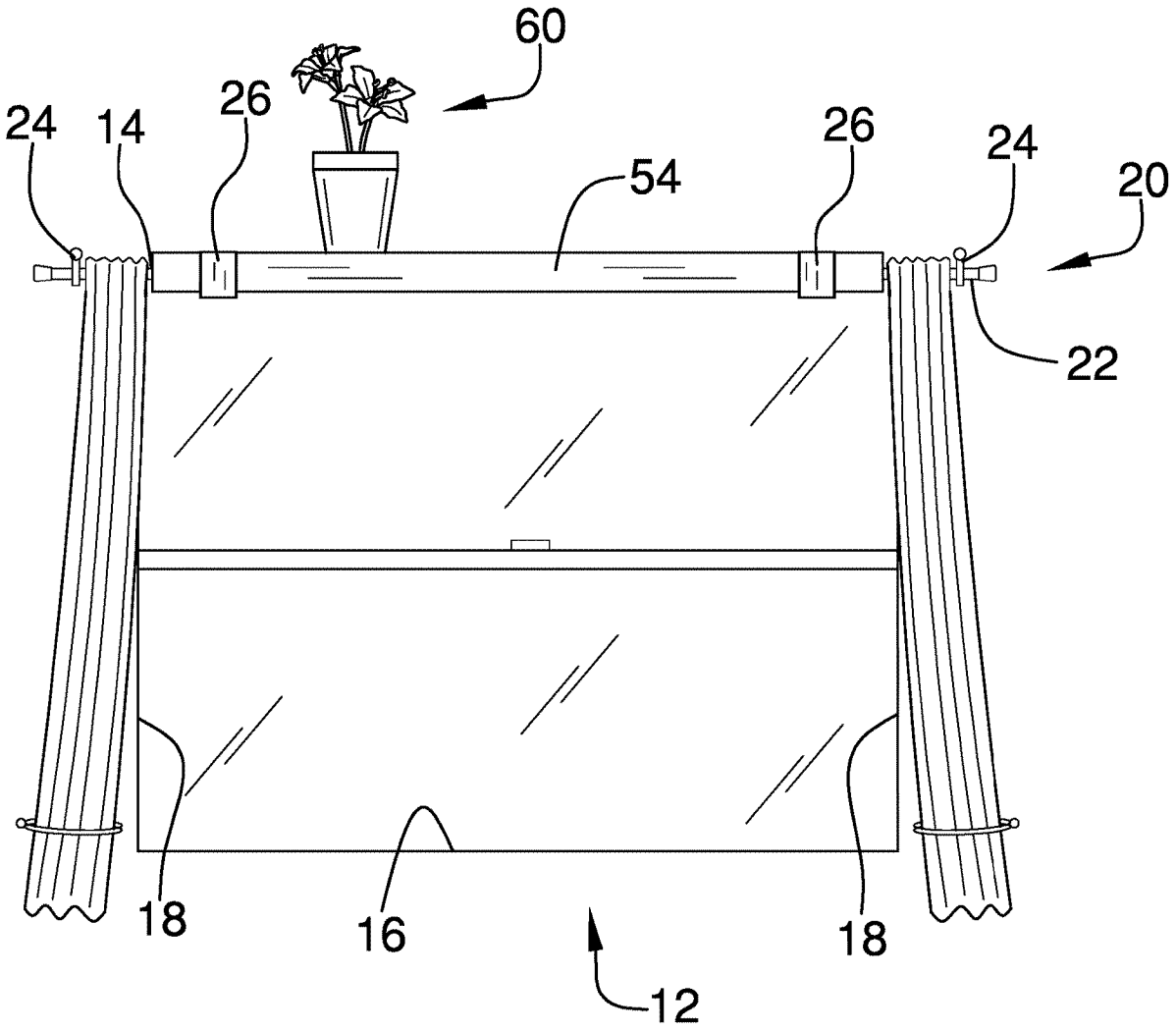
FIG. 7 is an in-use view of an embodiment of the disclosure.

With reference now to the drawings, and in particular to FIGS. 1 through 7 thereof, a new bracket embodying the principles and concepts of an embodiment of the disclosure and generally designated by the reference numeral 10 will be described.

As best illustrated in FIGS. 1 through 7, the plant storage mount system 10 generally comprises a window frame 12 including a top edge 14, a bottom edge 16, and a pair of lateral edges 18. The pair of lateral edges 18 is positioned perpendicular to the top edge 14 and the bottom edge 16. A curtain support 20 is coupled to the window frame 12 and is configured for suspending curtains therefrom. The curtain support 20 comprises a traverse rod 22 extending between the lateral edges 18 and is removably coupled proximate to a top edge 14 of the window frame 12. The curtain support 20 may include a pair of hooks 24, wherein the transverse rod is supported by the pair of hooks 24. Each of the hooks 24 may be coupled proximate to one of the pair of lateral edges 18.

A plurality of brackets 26 is mounted to the window frame 12. Each of the brackets 26 is elongated and has a top surface 28 and a bottom surface 30. Each of the brackets 26 includes a mounting section 32 being mounted to the top edge 14 of the window frame 12. The mounting section 32 includes a first side arm 34, a second side arm 36, and a center arm 38 positioned between the first side arm 34 and the second side arm 36. The bottom surface 30 of the second side arm 36 is positionable facing a top side of the traverse rod 22.

The top surface 28 of the first side arm 34 and the top surface 28 of the second side arm 36 are parallel to each other. The first side arm 34 is perpendicular to the center arm 38 such that a first juncture 40 of the first side arm 34 and the center arm 38 forms a first 90-degree angle 42 from the top surface 28 of the first side arm 34 to the top surface 28 of the center arm 38. The second side arm 36 is perpendicular to the center arm 38 such that a second juncture 44 of the second side arm 36 and the center arm 38 forms a second 90-degree angle 46 from the bottom surface 30 of the second side arm 36 to the bottom surface 30 of the center arm 38. The first side arm 34 has a pair of holes 48 extending therethrough. Each of the holes 48 is configured for receiving a mounting screw 50.

A receiving section 52 is configured for supporting a bottom side 56 of a shelf 54 thereon, wherein a top side 58 of the shelf 54 supports one or more plant pots 60 thereon. The receiving section 52 has a first lateral arm 62, a second lateral arm 64, and a base arm 66 positioned between the first lateral arm 62 and the second lateral arm 64. The top surface 28 of the base arm 66 is coplanar to the top surface 28 of the first side arm 34 of the mounting section 32. The base arm 66 has a pair of lateral ends 68. The first 62 and second 64 lateral arms each are coupled to one of the pair of lateral ends 68 and extend upwardly therefrom. The top surface 28 of the first lateral arm 62 forms a first obtuse angle 70 with the top surface 28 of the base arm 66. The top surface 28 of the second lateral arm 64 forms a second obtuse angle 72 with the top surface 28 of the base arm 66. A first end edge 74 of the first lateral arm 62 is attached to a second end edge 76 of the second side arm 36 to form a center juncture 78 between the receiving section 52 and the mounting section 32.

In use, the mounting section 32 of each bracket 26 attaches the window frame 12 by abutting the top surface 28 of the first side arm 34 and the top surface 28 of the center arm 38 against a corner of the top edge 14 of the window frame 12. Each of the holes 48 of the first side arm 34 receives a mounting screw 50 therethrough, wherein the mounting screw 50 of each hole secures the bracket 26 in place against the window frame 12. The shelf 54 is positioned on the receiving section 52 of each bracket 26, wherein the shelf 54 is cradled on base arm 66 between the first lateral arm 62 and the second lateral arm 64. The second side arm 36 of the mounting section 32 is spaced from the curtain support 20, wherein the curtain support 20 does not interfere with each of the brackets 26. One or more plant pots 60 are positioned on the top side 58 of the shelf 54 to receive indirect sunlight.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plant storage system configured for holding plant pots in indirect sunlight, said plant storage system comprising:

a window frame, said window frame including a top edge, a bottom edge, and a pair of lateral edges;

a curtain support being coupled to said window frame and being configured for suspending curtains therefrom;

a plurality of brackets being mounted to said window frame, each of said brackets being elongated and having a top surface and a bottom surface, each of said brackets including a mounting section being mounted to the top edge of the window frame, and a receiving section being configured for supporting a bottom side of a shelf thereon, wherein a top side of said shelf supports one or more plant pots thereon;

wherein said curtain support comprises a traverse rod extending between said lateral edges and being removably coupled proximate to a top edge of said window frame;

wherein said mounting section includes a first side arm, a second side arm, and a center arm being positioned between said first side arm and said second side arm, said bottom surface of said second side arm being positionable facing a top side of said traverse rod, said top surface of said first side arm and said top surface of said second side arm being parallel to each other, said first side arm being perpendicular to said center arm such that a first juncture of said first side arm and said center arm forming a first 90-degree angle from said top surface of said first side arm to said top surface of said center arm, said second side arm being perpendicular to said center arm such that a second juncture of said second side arm and said center arm forming a second 90-degree angle from said bottom surface of said second side arm to said bottom surface of said center arm, said first side arm having a pair of holes extending therethrough, each of said holes being configured for receiving a mounting screw; and wherein said receiving section has a first lateral arm, a second lateral arm, and a base arm being positioned between said first lateral arm and said second lateral arm, said top surface of said base arm being coplanar to said top surface of said first side arm of said mounting section, said base arm having a pair of lateral ends, said first and second lateral arms each being coupled to one of said pair of lateral ends and extending upwardly therefrom, said top surface of said first lateral arm forming a first obtuse angle with said top surface of said base arm, said top surface of said second lateral arm forming a second obtuse angle with said top surface of said base arm, a first end edge of said first lateral arm being attached to a second end edge of said second side arm to form a center juncture between said receiving section and said mounting section.

2. A plant storage system configured for holding plant pots in indirect sunlight, said plant storage system comprising:

a window frame, said window frame including a top edge, a bottom edge, and a pair of lateral edges, said pair of lateral edges being positioned perpendicular to said top edge and said bottom edge;

a curtain support being coupled to said window frame and being configured for suspending curtains therefrom, said curtain support comprising a traverse rod extending between said lateral edges and being removably coupled proximate to a top edge of said window frame; and a plurality of brackets being mounted to said window frame, each of said brackets being elongated and having a top surface and a bottom surface, each of said brackets including:

a mounting section being mounted to the top edge of the window frame, said mounting section including a first side arm, a second side arm, and a center arm being positioned between said first side arm and said second side arm, said bottom surface of said second side arm being positionable facing a top side of said traverse rod, said top surface of said first side arm and said top surface of said second side arm being parallel to each other, said first side arm being perpendicular to said center arm such that a first juncture of said first side arm and said center arm forming a first 90-degree angle from said top surface of said first side arm to said top surface of said center arm, said second side arm being perpendicular to said center arm such that a second juncture of said second side arm and said center arm forming a second 90-degree angle from said bottom surface of said second side arm to said bottom surface of said center arm, said first side arm having a pair of holes extending therethrough, each of said holes being configured for receiving a mounting screw; and a receiving section being configured for supporting a bottom side of a shelf thereon, wherein a top side of said shelf supports one or more plant pots thereon, said receiving section having a first lateral arm, a second lateral arm, and a base arm being positioned between said first lateral arm and said second lateral arm, said top surface of said base arm being coplanar to said top surface of said first side arm of said mounting section, said base arm having a pair of lateral ends, said first and second lateral arms each being coupled to one of said pair of lateral ends and extending upwardly therefrom, said top surface of said first lateral arm forming a first obtuse angle with said top surface of said base arm, said top surface of said second lateral arm forming a second obtuse angle with said top surface of said base arm, a first end edge of said first lateral arm being attached to a second end edge of said second side arm to form a center juncture between said receiving section and said mounting section.

* * * * *